US005806255A

United States Patent [19]

Verby et al.

[11] Patent Number: 5,806,255

[45] Date of Patent: Sep. 15, 1998

[54] SKYLIGHT AND METHOD TO INSTALL

[75] Inventors: Stanley M. Verby, Hewlett Harbor; Barry Mirsky, Hauppauge, both of N.Y.

[73] Assignee: Thermo-Vu Sunlite Industries, Inc., Edgewood, N.Y.

[21] Appl. No.: 746,544

[22] Filed: Nov. 13, 1996

Related U.S. Application Data

[60] Provisional application No. 60/006,644, Nov. 13, 1995.

[51] Int. Cl.[6] ..... E04B 7/18

[52] U.S. Cl. ..... 52/200; 52/58; 52/745.16; 52/745.2

[58] Field of Search ..... 52/200, 58, 745.16, 52/745.2

[56] References Cited

U.S. PATENT DOCUMENTS

| | | | |
|---|---|---|---|
| 4,594,821 | 6/1986 | Bechtold et al. | 52/200 X |
| 4,930,275 | 6/1990 | Verby et al. . | |
| 4,986,039 | 1/1991 | Weisner | 52/200 X |
| 5,103,603 | 4/1992 | Verby et al. . | |
| 5,355,644 | 10/1994 | Guhl et al. | 52/200 |
| 5,553,425 | 9/1996 | Sampson et al. | 52/200 X |

*Primary Examiner*—Christopher Kent
*Attorney, Agent, or Firm*—Darby & Darby

[57] ABSTRACT

A skylight assembly to be secured to an exterior surface of a roof includes a frame assembly having walls, an upper peripheral edge, and an outer wall surface. Angled brackets are used to secure the entire skylight assembly to the roof surface. Each angled bracket includes a first arm which is attached to a portion of the outer wall surface of the frame assembly and a second arm which is positioned generally perpendicular to, and outwardly from the outer wall surface of the frame assembly. The second arm of each bracket is adapted to be fastened to the exterior surface of the roof. A flashing assembly surrounds the frame and includes a vertical portion which is positioned parallel and adjacent to the outer wall surface and a horizontal portion which is positioned parallel to and above the second arm. The second arm of each bracket includes an accessible portion which extends outwardly past the horizontal portion of the flashing. The accessible portion is adapted to receive appropriate fasteners and secure the second arm to the exterior of the roof.

4 Claims, 2 Drawing Sheets

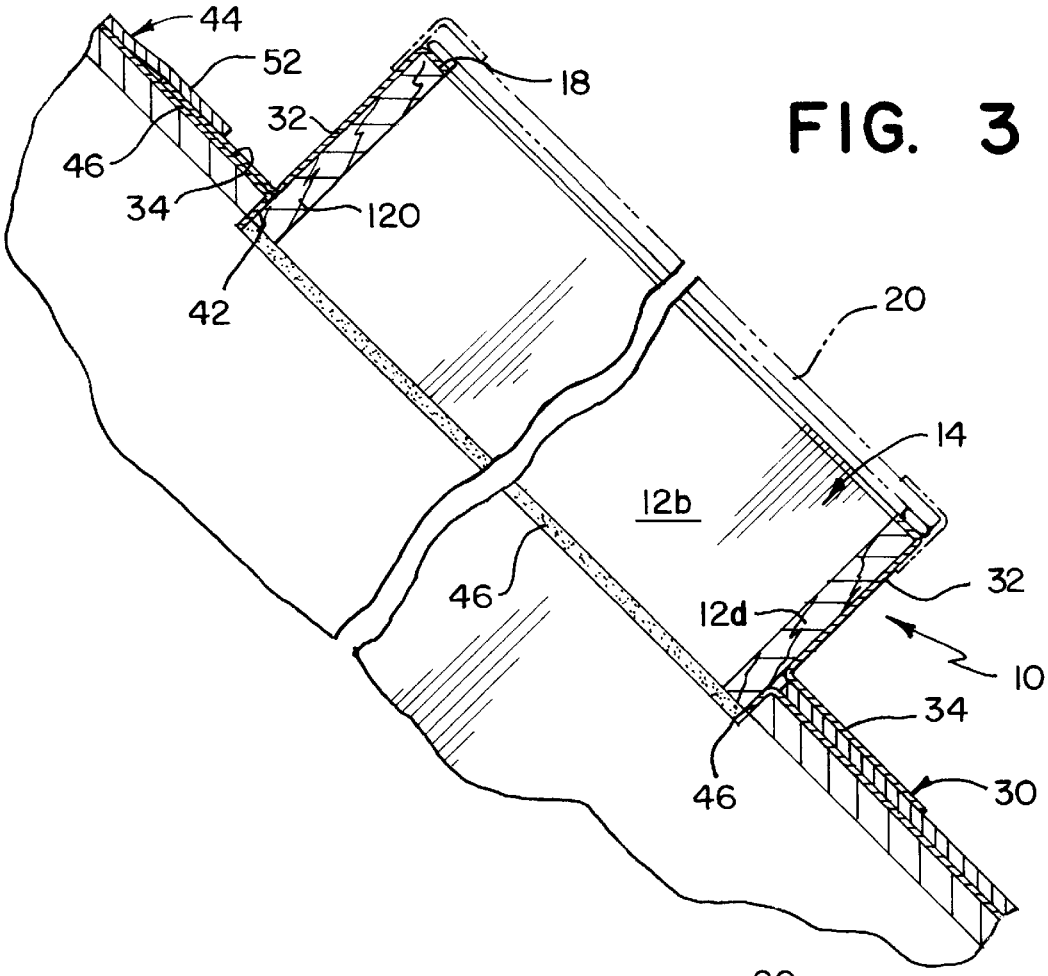
FIG. 3
FIG. 4
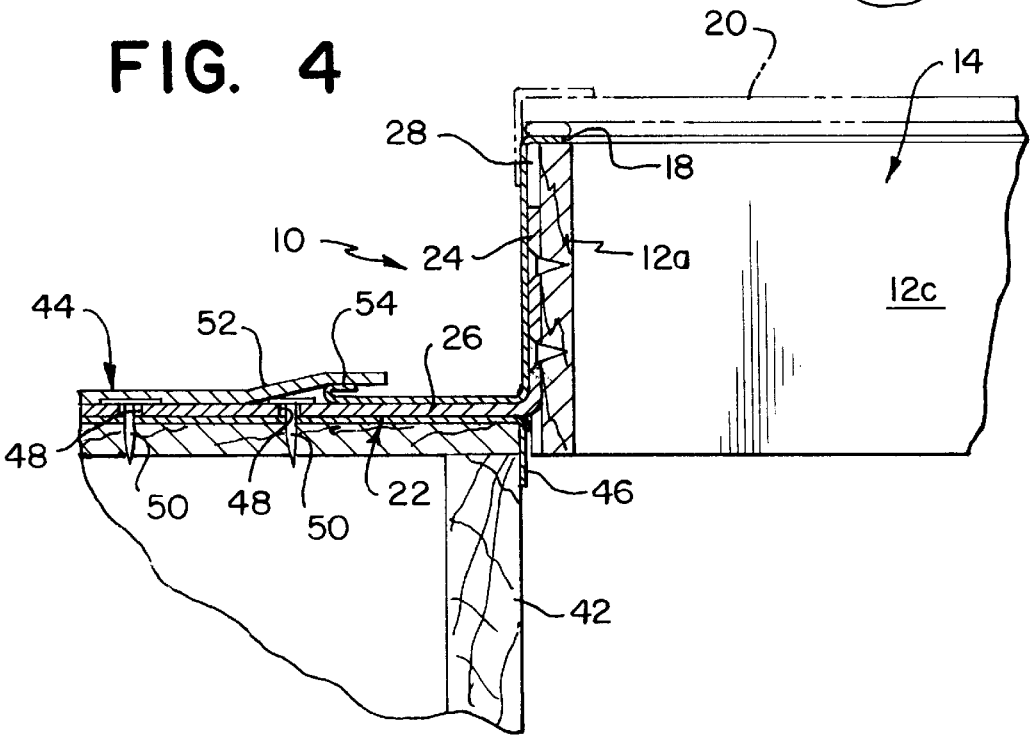

SKYLIGHT AND METHOD TO INSTALL

FIELD OF THE INVENTION

This invention generally relates to skylight fixtures (or roof windows) of the type which are installed within the roof of a building, and more particularly, to skylight frame curb and flashing assemblies and methods of installing such assemblies within the roof structure.

BACKGROUND OF THE INVENTION

The recent interest in contemporary architecture, particularly in connection with residential buildings, has resulted in a substantial increase in the demand for skylight assemblies. Installers of such skylights (roofers) have concomitantly demanded that the skylight fixtures be simple in structure and easy to install within a roof structure of a building.

One particular problem with current skylight assemblies is that a roofer is usually required to climb onto a roof, make an appropriate opening within the roof to accommodate the skylight, position the skylight within the opening, then climb back down and access the inside portion of the unsecured skylight to secure the skylight to the frame structure of the roof (usually to a prepared frame surrounding the opening). Typically, the roofer must climb an interior ladder to access and secure the skylight. This apparently simple task of securing a skylight from within the building structure increases unnecessary risk to the roofer and extends the installation time of the skylight.

Accordingly, one object of the invention is to provide a skylight assembly which is simple to install and otherwise overcomes the deficiencies of the prior art.

Another object of the invention is to provide a skylight assembly which may be quickly and easily installed to a roof surface completely from the exterior of the building structure.

SUMMARY OF THE INVENTION

A skylight assembly to be secured to an exterior surface of a roof comprises a frame assembly having walls including an upper peripheral edge and an outer wall surface. Angled brackets are used to secure the entire skylight assembly to the roof surface. Each bracket includes a first arm which is attached to a portion of the outer wall surface and a second arm which is positioned generally perpendicular to, and outwardly from the outer wall surface of the frame. The second arm of each bracket is adapted to be fastened to the exterior surface of the roof. A factory installed flashing assembly surrounds the frame and includes a vertical portion which is positioned parallel and adjacent to the outer wall surface and a horizontal portion which is positioned parallel to and above the second arm. The second arm of each bracket includes an accessible portion which extends outwardly past the horizontal portion of the flashing. Securing means is used to secure the accessible portion of the second arm to the exterior of the roof.

BRIEF DESCRIPTION OF THE DRAWING FIGURES

FIG. 3 is a sectional side view of the skylight assembly taken along the line 3—3 of FIG. 2; and FIG. 4 is a sectional side view of the skylight assembly taken along the line 4—4 of FIG. 2.

DETAILED DESCRIPTION OF THE PREFERRED EMBODIMENT

Figure 1:
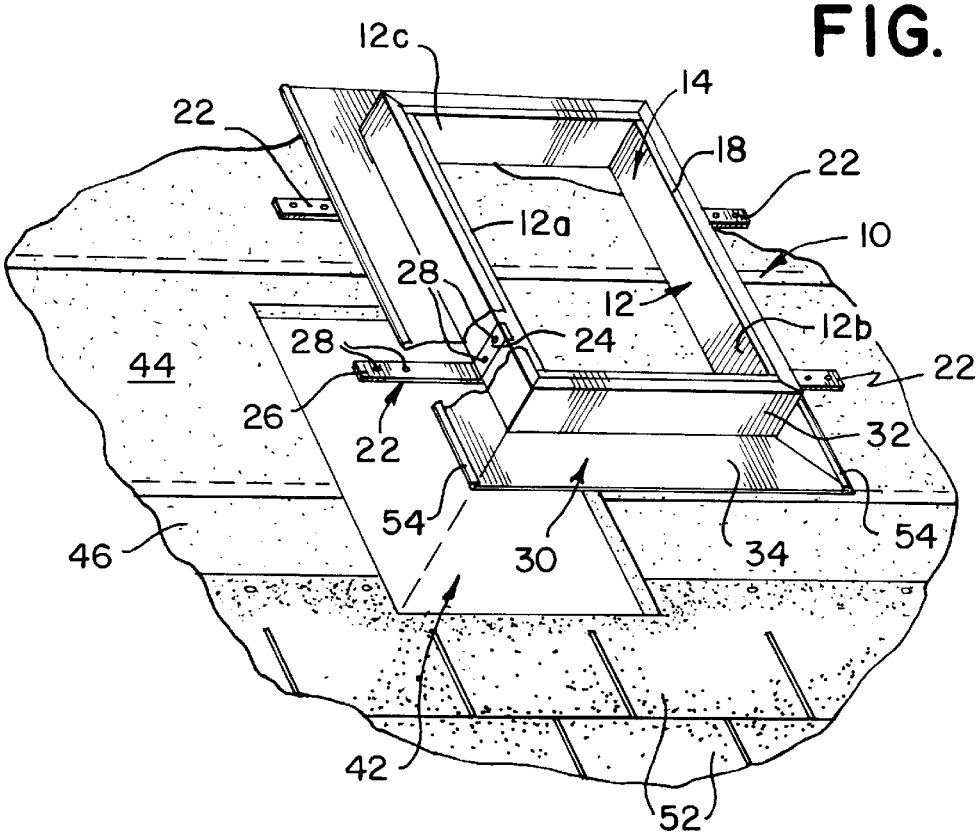
FIG. 1 is an exploded perspective view of the skylight assembly in accordance with the invention shown in a pre-installed position.

Referring to FIG. 1, there is shown a skylight assembly 10 in accordance with the present invention including a generally rectangular frame assembly 12 defining an opening 14. The frame may be of any shape, including but not limited to square and trapezoidal. In the illustrative embodiment, the rectangular frame 12 includes long side walls 12*a* and 12*b* interconnected by shorter frame walls 12*c* and 12*d*. A transparent sheet 20 made from glass or plastic is mounted to the frame assembly 12 across the opening 14, and appropriately sealed against the upper peripheral edge 18 of frame 12 in a conventional manner to be selectively opened or permanently sealed. Preferably, four mounting brackets 22 are secured to the outer surfaces of the frame walls 12*a* and 12*b*, one bracket 22 located near each end of each member 12*a*, 12*b*, as shown in FIG. 1. Each mounting bracket 22 includes a vertical skylight arm 24 and a horizontal roof arm 26, as shown in FIG. 4.

The frame assembly 12 preferably includes four dado-type grooves 28 located within the outer side surfaces of frame walls 12*a* and 12*b* to receive the skylight arms 24 of each of the four mounting brackets 22. The depth of each groove 28 is at least equal to the thickness of the mounting brackets 22 so that when secured within a respective groove 28, the skylight arm 24 of the mounting bracket 22 remains either flush with respect to the outer side surface of the frame member, or lies slightly deeper within the groove 24. Each mounting bracket 22 is secured to the frame assembly 12, within the respective groove 28 using wood screws, or any other appropriate fastener depending on the material of the frame assembly 12.

A flashing 30 (FIG. 3) is mounted to the frame assembly 12 to prevent leakage. The flashing 30 is generally "L" shaped in cross-section (the precise shape being shown in FIG. 4) and includes a vertical wall 32 connected to a horizontal panel 34. The flashing 30 is formed into a shape similar to the shape of the frame assembly 12. The flashing 30 may consist of four mitred sections (not numbered) assembled in conventional fashion and configured so that the vertical wall 32 of the flashing 30 snugly fits around the outer surface of the frame assembly 12, leaving the horizontal panel 34 of the flashing 30 parallel to the plane of the transparent sheet 20 and parallel to the roof surface 44. The roof arm 26 of each mounting bracket 22 must extend outwardly beyond the flashing 30 so that each roof arm 26 may be secured to the roof surface 44. As shown in FIG. 4, the portion of the bracket arm 26 which extends outwardly beyond the flashing 30 includes two holes 48 so that the mounting brackets, and thereby the entire frame assembly, can be secured to the roof as explained below.

In accordance with the invention, it is preferred that the skylight arm 24 of each mounting bracket 22 be secured to the frame assembly 12 within a respective groove 28, and the entire flashing assembly 30 be mounted to the frame assembly 12 over the skylight arms 24 of each mounting bracket 22. The skylight assembly 10 is intended to be sold as a pre-assembled, easy-to-install roof fixture.

In operation, the installer or roofer must first cut a roof-opening 42 in the roof 44 of a building which is sized and shaped similar to the size and shape of the frame assembly 12. The skylight assembly 10, in accordance with the invention, is positioned within the roof-opening 42 so that the horizontal panel 34 of the flashing 30 lies against the surface of the roof 44 (against appropriate layers of insulation and/or roofing paper 46). Once in position, the installer fastens the exposed portions of each roof arm 26 of each mounting bracket 22 to the roof surface 44 by securing appropriate fasteners 50, such nails or wood screws, through the openings 48 within the bracket 22. One benefit of the present skylight structure is that the installation is simple and quick, amounting to merely fastening the exposed portions of each bracket 22 to the roof 44 and applying shingles to the area to seal the skylight against the roof. The present invention thus obviates the need to fasten the skylight from within the building structure.

Figure 2:
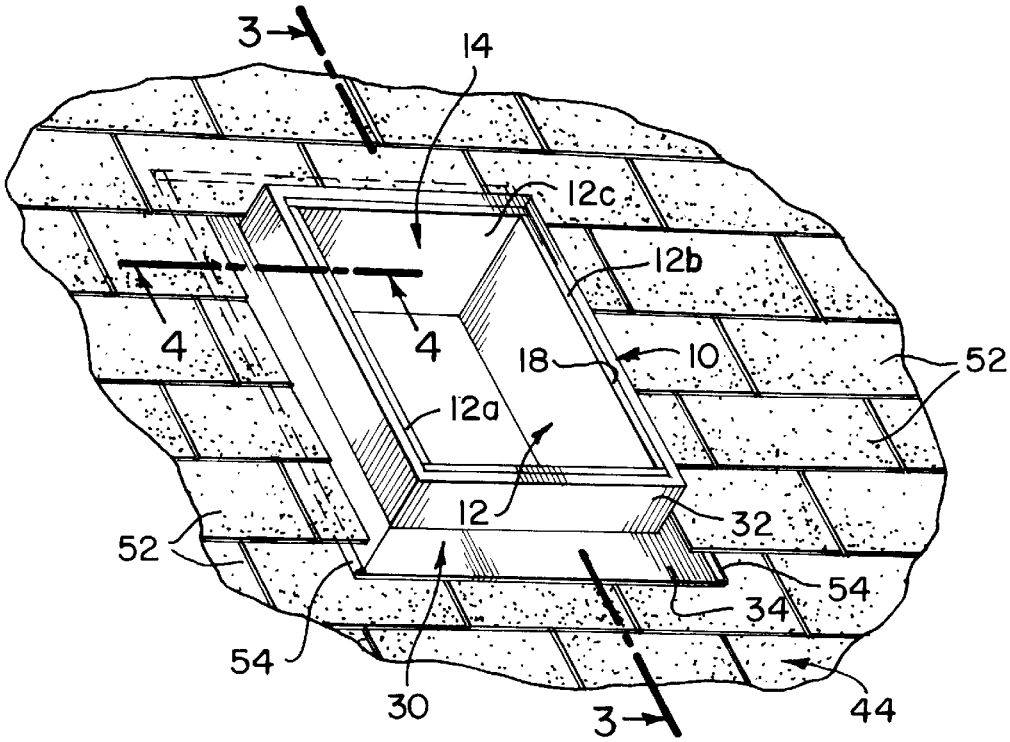
FIG. 2 is a perspective view of the skylight assembly in accordance with the invention shown installed within the roof of a building structure.

When applying roof shingles 52 adjacent to the skylight, the installer should consider the entire skylight assembly 10 as a single shingle so that shingles above the skylight will ride over the flashing panel 34, as shown in FIG. 3, and shingles extending downward from the bottom of the skylight should be positioned so that the flashing rides over them, as shown in FIGS. 2 and 3. This arrangement ensures that any runoff of water down across the roof shingles 52 will similarly run onto the flashing 30 of the skylight 10 and continue back onto the roofing shingles 52 without interrupted flow or finding a point of entry into the roof structure.

To prevent runoff water from entering past the flashing, the outermost edge of the flashing panel 34 is provided with a curled gutter-like channel 54. The roof shingles 52 are secured to the roof with a slight (about three inches) overlap onto the flashing panels 34 and over the gutter-like channels 54, as shown in FIGS. 2 and 4.

Any water flowing down the roof shingles 52 will flow past the frame assembly 12. If any of the water develops any lateral movement, the channels 52 of each flashing panel 34 will divert the flow of water away from the side edge of the flashing 30 and back to a downward direction so that no water will flow between the shingles 50 and the roof surface 44.

What is claimed is:

1. A skylight assembly to be secured to an exterior surface of a roof, comprising:

a frame assembly having walls including an upper peripheral edge and an outer wall surface, said frame assembly defining a central opening;

at least one angled bracket having a first arm which is attached to a portion of said outer wall surface and a second arm, positioned generally perpendicular to, and outwardly from said outer wall surface of said frame, said second arm of said bracket being adapted to be fastened to the exterior surface of the roof;

a flashing assembly surrounding said frame and including a vertical portion which is positioned parallel and adjacent to said outer wall surface, and a horizontal portion which is positioned parallel to and above said second arm, wherein said second arm of said bracket includes an accessible portion which extends outwardly past said horizontal portion of said flashing; and means for securing said accessible portion of said second arm to said exterior surface of the roof.

2. The skylight assembly according to claim 1, wherein said flashing assembly includes an upper flashing portion, a lower flashing portion and two side flashing portions, said upper flashing portion being adapted to fit under an adjacent roofing shingle, said lower flashing portion being adapted to lie over an adjacent lower roofing shingle.

3. The skylight assembly according to claim 2, wherein said side flashing portions each include outer edges which are curved upwardly defining a respective channel, said channel being adapted to capture and stop any laterally flowing water and direct the water longitudinally along the length of said side flashing portions and down the exterior surface of the roof.

4. A method for securing a skylight to an exterior surface of a slanted roof, said skylight including a frame assembly having outer wall surfaces and defining a peripheral edge surrounding an opening, a flashing assembly including an upper portion, two side portions and a lower portion, said flashing assembly being sized and shaped to cover and protect a region between said peripheral edge of the frame assembly and the exterior surface of the roof, at least two brackets attached to said outer wall surface, with each including an outwardly directed mounting arm, said mounting arm including an accessible portion extending outwardly past said flashing, said method comprising the steps of:

establishing an opening in said roof;

positioning said skylight within said opening;

securing said accessible portions of said mounting arms of the two brackets to said exterior surface of said roof; and securing roof shingles to said exterior of said roof so that shingles located adjacent said upper portion of said flashing include a portion positioned over said flashing and shingles located adjacent said lower portion of said flashing include a portion positioned under said flashing.

* * * * *